US007111759B1

(12) United States Patent
Gorski et al.

(10) Patent No.: US 7,111,759 B1
(45) Date of Patent: Sep. 26, 2006

(54) SANITARY, VENTED AND DISPOSABLE DISPENSING ASSEMBLY FOR POST MIX BEVERAGE DISPENSER

(75) Inventors: Chris W. Gorski, Fort Atkinson, WI (US); Jerry D. Scheiber, Watertown, WI (US)

(73) Assignee: Karma, Inc., Watertown, WI (US)

( * ) Notice: Subject to any disclaimer, the term of this patent is extended or adjusted under 35 U.S.C. 154(b) by 325 days.

(21) Appl. No.: 10/777,815

(22) Filed: Feb. 12, 2004

(51) Int. Cl.
*B67D 5/60* (2006.01)
*B67D 3/00* (2006.01)
*B67D 6/06* (2006.01)
*B05B 12/00* (2006.01)

(52) U.S. Cl. ..... 222/145.6; 222/523

(58) Field of Classification Search ..... 222/129.1, 222/129.2, 129.3, 144.5, 145.1, 145.2, 145.3, 222/145.4, 145.5, 145.6, 475, 523, 524, 531, 222/537, 539, 559; 251/353, 341, 349; 239/320, 239/433, 434; 4/144.1
See application file for complete search history.

(56) References Cited

U.S. PATENT DOCUMENTS 2,160,983 A * 6/1939 Painter ..... 222/129.3
2,823,833 A * 2/1958 Bauerlein ..... 222/129.2
2,891,578 A * 6/1959 Erickson et al. ..... 138/45
2,983,279 A * 5/1961 Biermann ..... 137/100
3,756,473 A * 9/1973 Donahue, Jr. ..... 222/129.2
4,750,645 A 6/1988 Wilson et al.
5,000,348 A * 3/1991 Emody ..... 222/66
5,353,963 A 10/1994 Gorski et al.
6,149,035 A * 11/2000 Gorski et al. ..... 222/129.4
6,193,109 B1 * 2/2001 Credle et al. ..... 222/129.4
6,401,981 B1 * 6/2002 McCann et al. ..... 222/129.1

* cited by examiner

*Primary Examiner*—Kevin Shaver
*Assistant Examiner*—Stephanie E. Tyler
(74) *Attorney, Agent, or Firm*—Andrus, Sceales, Starke & Sawall, LLP

(57) ABSTRACT

A sanitary, disposable dispensing assembly especially useful in producing a substantially contaminant-free reconstituted mixture of diluent and pure, preservative-free concentrate includes an inner member linearly slidable between open and closed positions in an outer member provided with a concentrate inlet. The dispensing assembly features a vent arrangement for enabling a complete draining of the mixture and preventing bacterial growth. A rib arrangement improves mixing of the combined diluent and concentrate, and prevents dispersion of the mixture when dispensed. The dispensing assembly is utilized in mechanical pump type and non-mechanical pump type applications on a post mix food and beverage dispenser.

11 Claims, 7 Drawing Sheets

SANITARY, VENTED AND DISPOSABLE DISPENSING ASSEMBLY FOR POST MIX BEVERAGE DISPENSER

FIELD OF THE INVENTION

The invention relates generally to an apparatus for dispensing liquid food and beverages and, more particularly, pertains to a sanitary, disposable dispensing assembly for post mix combination of certain non-refrigerated and non-heated, pure and preservative-free food and beverage concentrates with a diluent so as to produce a uniformly and properly mixed beverage which is substantially free of contamination.

BACKGROUND OF THE INVENTION

Various food and beverage systems are known in the art for blending a concentrate of relatively high viscosity with a diluent having a relatively low viscosity. Typical post mix food and beverage dispensers are designed to separately store and to automatically combine at the time of dispensing a concentrate and a diluent such as water at a predetermined ratio in order to consistently produce a food or beverage which is acceptable for consumption.

Certain pure beverage concentrates, such as milk, creamer and brewed ice tea, become unstable when contaminated by contact with the diluent, airborne bacteria, bacteria present on human hands, or from reusable parts which have not been properly sanitized. This need for a bacteria-free, controlled environment when using pure food and beverage concentrates in current art results in costly dispensing systems, high distribution handling and storage expenditures and expensive cleaning and sanitizing systems/procedures to be utilized by the operator wishing to offer these pure products to consumers.

One general attempt in current art to prevent contamination of the concentrate is to add preservatives to the concentrate which retard bacteria growth. Post mix food and beverages containing preservatives are less desirable to the consumer because of the foreign taste created by the addition of the preservative or due to the fear on the consumer's part that consuming the preservative may cause a health risk at some future point.

Another attempt in current art to retard bacteria growth is to house the pure food and beverage base concentrates in a refrigerated, automatically controlled and managed environment throughout the life of the concentrate beginning with the production stage and ending with the consumption stage. This refrigerated method to retard bacteria growth is a very costly method requiring expensive refrigerated handling, warehousing and monitoring, and uninterrupted electrical supply and regular maintenance of the refrigeration equipment throughout the distribution chain in addition to requiring a post mix dispenser having a refrigerated holding environment. Still, the possibility of bacteria growth exists if the reusable food zone parts of the refrigerated post mix dispenser are not thoroughly cleaned and sanitized at regular intervals.

Another attempt in current art to retard bacteria growth is to incorporate in the post mix dispenser, an automatic hot water sanitizing cycle at regular intervals of the reusable food zone parts. This method is also a costly one requiring regular monitoring and maintenance of the hot water sanitizing components to ensure the proper temperature is maintained, the proper volume of hot water is dispensed at the proper intervals and that emergency electrical power is available in the event a publicly supplied power outage occurs.

Another attempt in current art to retard bacteria growth is to prevent the pure concentrate from coming into contact with the diluent until it reaches the vessel from which the reconstituted food or beverage is delivered for consumption. This method is commonly referred to as the "split flow" method whereby concentrate is metered through its self-contained tubing which is an integral component of its packaging, ejected from this tubing separate from but in conjunction with a diluent stream directly into the consumption vessel. In many cases, this method is not desirable by the consumer because of the inadequate mixing results either visible or in the tasting of the reconstituted mixture, or because of the unsightly dual streams of concentrate and diluent entering the serving vessel during the dispensing cycle. Still, the possibility of bacteria contamination of the exposed outlet end of the concentrate tubing exists should it be opened with a contaminated instrument such as a scissors or knife or should it come into contact with airborne bacteria. Of course, there is always the possibility that the mixed beverage could be delivered into a contaminated container or come into contact with contaminated human hands, but these situations are beyond the design of the post mix dispenser and the dispensing assembly.

It is therefore desirable that a food and beverage dispensing system be able to utilize pure, preservative-free concentrates without depending or relying on a refrigerated environment inside the dispenser, refrigerated handling and storage of the concentrate, a manual nor an automatic hot water sanitizing cycle to prevent or retard bacteria growth, the cleaning and sanitizing of reusable food zone parts, the separation of concentrate in water when exiting the dispenser and a continual source of electricity to stop or curtail bacteria growth. It is further desirable that the food and beverage concentrate container along with its tubing, a vented cap/plug valve and its dispense spout be disposable once acceptable evacuation of the concentrate is achieved. It is further desirable that the vented plug valve and dispense spout also function as a non-mechanical pump, combining the food or beverage concentrate with the diluent to produce a mixture of uniform consistency when post mix dispensing occurs.

One example of a disposable dispensing assembly and mixing valve which aims to improve sanitation of the beverage dispenser is disclosed in U.S. Pat. No. 4,750,645 issued Jun. 14, 1988 to Wilson et al. In this design, however, concentrate is apt to remain in the mixing valve even after the mixed product is dispensed thereby creating a host for bacterial growth and contamination. In addition, this mixing valve includes a turbulence-producing, flow restriction which prevents its use as a non-mechanical pump. Further, this valve can be improved to enhance the mixing, sealing and delivery of the combined concentrate and diluent.

SUMMARY OF THE INVENTION

The present invention advantageously provides an improved dispensing assembly having a unique arrangement of disposable components making it possible to post mix pure, preservative-free food and beverage concentrates without the need of mechanical devices to create and monitor a cold and/or hot environment to prevent or retard bacteria growth, nor require human action to periodically clean and sanitize reusable food zone parts. The dispensing assembly is vented so that all reconstituted concentrated diluent drains out after each dispense. The vented disposable dispensing assembly of the present invention also functions as a sanitary leak proof cap, plug, shut-off valve and spout on the end of the tubing attached to the disposable concentrate container. In addition, the vented disposable dispensing assembly of the present invention can also serve as a non-mechanical pump which combines the concentrate and diluent, dispensing them in a uniform consistency. Further, the dispensing system of the present invention eliminates the need for the disposable flexible concentrate package to be housed in a rigid container or have any other mechanical method to ensure complete acceptable evacuation of its contents.

In one aspect of the invention, a sanitary, disposable dispensing assembly is provided for producing a reconstituted food and beverage by combining a diluent and a food and beverage concentrate. The dispensing assembly includes a dispense spout uniquely coupled to a body. The dispense spout has an internal surface defining a continuous internal throughbore running through a horizontal portion, and a vertical portion joined by an elbow portion. The vertical portion has an outlet for the reconstituted beverage and a plurality of ribs running axially along the internal surface thereof. The elbow portion has a vent opening communicating the throughbore with outside atmosphere. The horizontal portion has a vertical passageway formed with an upper opening and a lower opening, the vertical passageway intersecting the throughbore. The body has an internal surface defining an internal bore formed therethrough. A diluent inlet is used to provide diluent flow along a horizontal path of the internal bore. A concentrate inlet has a vertical throughway in communication with the internal bore. The body has an open end opposite the diluent inlet for slidably receiving in a linear motion the horizontal portion of the dispense spout between a closed position wherein the vertical throughway is out of alignment with the vertical passageway and the throughbore of the dispense spout, and an open position wherein the vertical throughway is aligned with the vertical passageway of the throughbore. The vertical passageway and the throughbore define a mixing chamber for the diluent and the beverage concentrate.

A guiding arrangement is provided in the dispense spout in the body for slidably moving the dispense spout along a predetermined linear path relative to the body. The guiding arrangement includes a resilient, deformable lock tab structure protruding outwardly from an external surface of the dispense spout, and a horizontally extending key slot structure provided internally on the body. The key slot structure has enlarged end segments connected by a narrow channel. The key slot structure slidably receives the lock tab structure. A plurality of sealing beads extend circumferentially around the external surface of the dispense spout in the horizontal portion thereof. The sealing beads are sealingly engaged with the internal surface of the body. The diluent inlet is formed with a hexagonally-shaped recess adapted to mate with a hexagonal head of a diluent nozzle mounted on a food and beverage dispenser. The upper opening of the vertical passageway in the dispense spout has a diameter which is larger than the diameter of the lower opening. The throughbore of the dispense spout increases in size from the horizontal portion to the vertical portion. The concentrate inlet is positioned either upwardly or downwardly when the body is cooperatively engaged with the dispense spout. In one preferred embodiment, the concentrate inlet on the dispense valve is adapted to be connected to a concentrate vessel positioned above the dispense spout and having the delivery conduit engaged with the concentrate pump mounted on a food and beverage dispenser. In another embodiment, the concentrate inlet is adapted to be connected to a concentrate vessel located beneath the dispense spout and having a delivery conduit independent of a concentrate pump on a food and beverage dispenser. The internal surface of the dispense spout is formed with a flow-diverting deflector adjacent the vent opening.

In another aspect of the invention, a dispensing assembly is provided for producing reconstituted consumable liquids by combining and mixing a diluent and a liquid concentrate supplied through a delivery conduit from a concentrate vessel provided on a food and beverage dispenser. The dispensing assembly has an inner member movable within an outer member provided with a concentrate inlet between a closed position in which the concentrate inlet is sealed, and an open position in which the concentrate inlet communicates with the interior of the dispensing assembly to deliver a reconstituted mixture of diluent and liquid concentrate in a flow path to a mixture outlet. The invention is improved by means of a vent arrangement formed in the inner member for communicating the interior of the dispensing assembly with the atmosphere outside the dispensing assembly, and enabling the draining of a maximum amount of reconstituted mixture through the mixture outlet.

A guiding arrangement is provided between the inner member and the outer member for enabling sliding movement of the inner member relative to the outer member along a predetermined linear horizontal path. A rib arrangement is provided in the inner member for improving mixing of the combined diluent and liquid concentrate, and preventing dispersion of the reconstituted mixture from the mixture outlet. The dispenser is provided with a bracket structure for retaining an end of the concentrate vessel. In one particular application, the inner member is formed with a vertical passageway alignable with the concentrate inlet, the concentrate inlet being positioned and the vertical passageway being sized such that diluent flowing past the vertical passageway causes liquid concentrate to be suctioned from the concentrate vessel when the concentrate vessel is located beneath the dispensing assembly. The delivery conduit is provided with a pinch valve for regulating the flow of liquid concentrate from the concentrate vessel to the dispensing assembly. Locating structure is provided on the inner member and the outer member for internally and externally locating the dispensing assembly relative to a diluent nozzle mounted on the dispenser. The inner member is sealingly engaged with the diluent nozzle when the dispensing assembly is in the open position. The inner member is formed with a deflector adjacent the vent opening for diverting mixture flow therefrom. The liquid concentrate is preferably pure and preservative-free, and the reconstituted mixture is substantially contaminant free.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 3*a* is a sectional view taken on line 3*a*—3*a* of FIG. 3;

DETAILED DESCRIPTION OF THE INVENTION

The food and beverage dispenser used with the present invention is a post mix machine which is particularly adapted to automatically combine certain pure and preservative-free concentrates, such as milk, creamer, brewed ice tea and cappuccino, with a diluent, such as water, and discharge the mixture on demand. Most typically, when a machine is used as a food and beverage dispenser, it may be utilized for dispensing metered quantities of single or multiple liquid foods and beverages, such as plain or flavored mixtures of milk, tea or coffee whose preservative-free concentrates are aseptically packaged and do not require any internal or external treatment for preservation. However, it should be understood that the present invention may also be used in other dispensing applications.

Figure 1A:
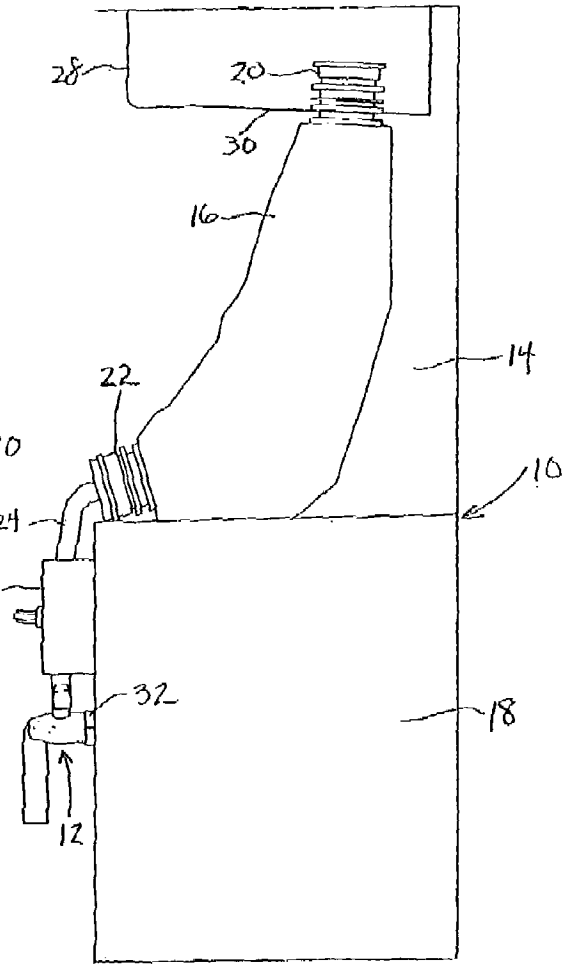
FIG. 1*a* is a side view of FIG. 1.
Figure 1:
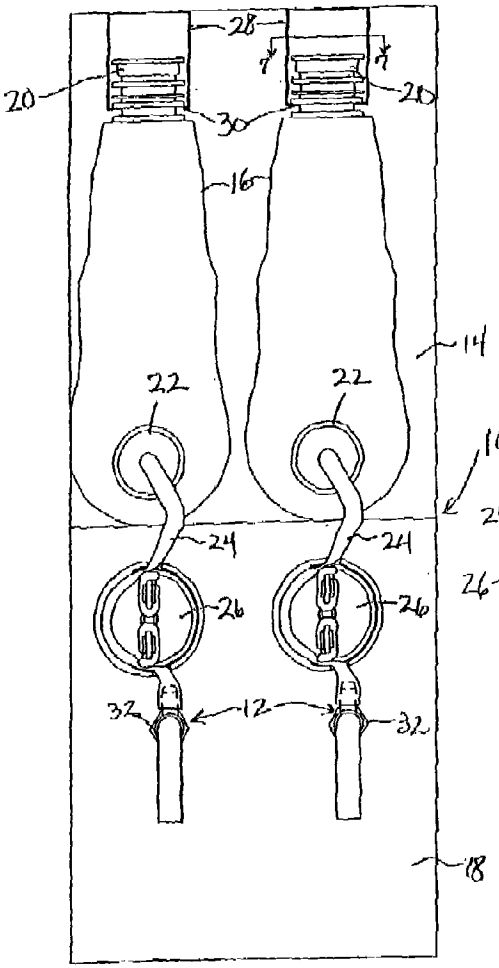
FIG. 1 is a partial, front view of a mechanical pump type, post mix beverage dispensing machine employing the sanitary, vented, disposable dispensing assembly of the present invention.
Figure 2A:
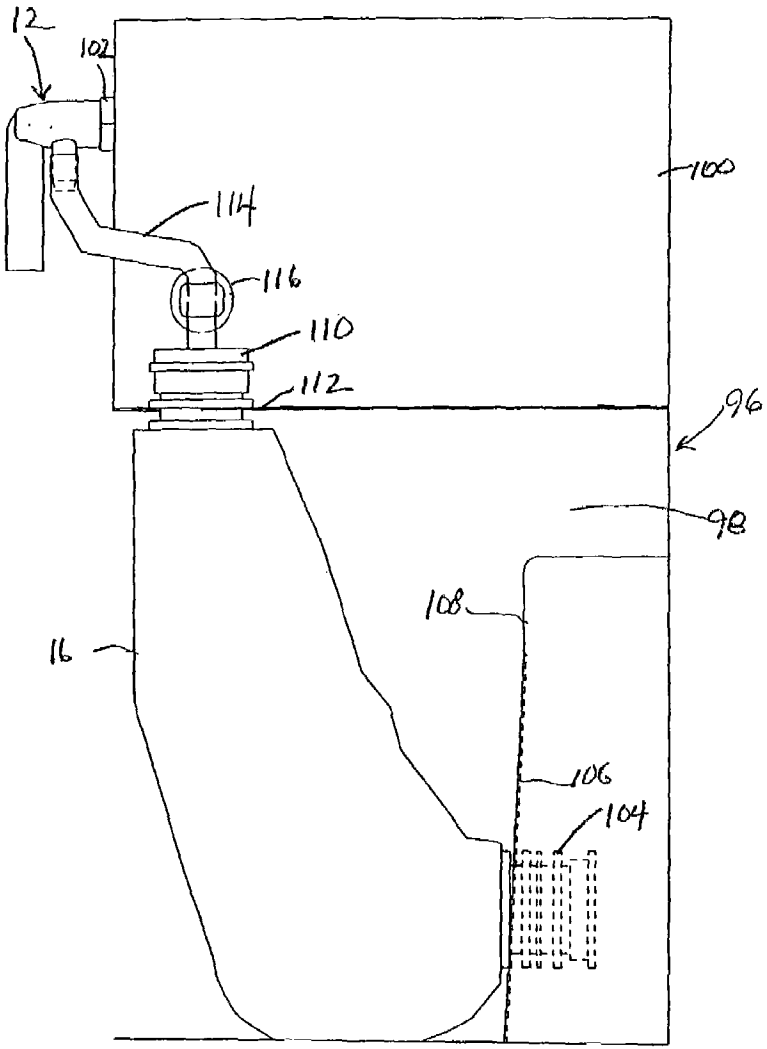
FIG. 2*a* is a side view of FIG. 2.
Figure 2:
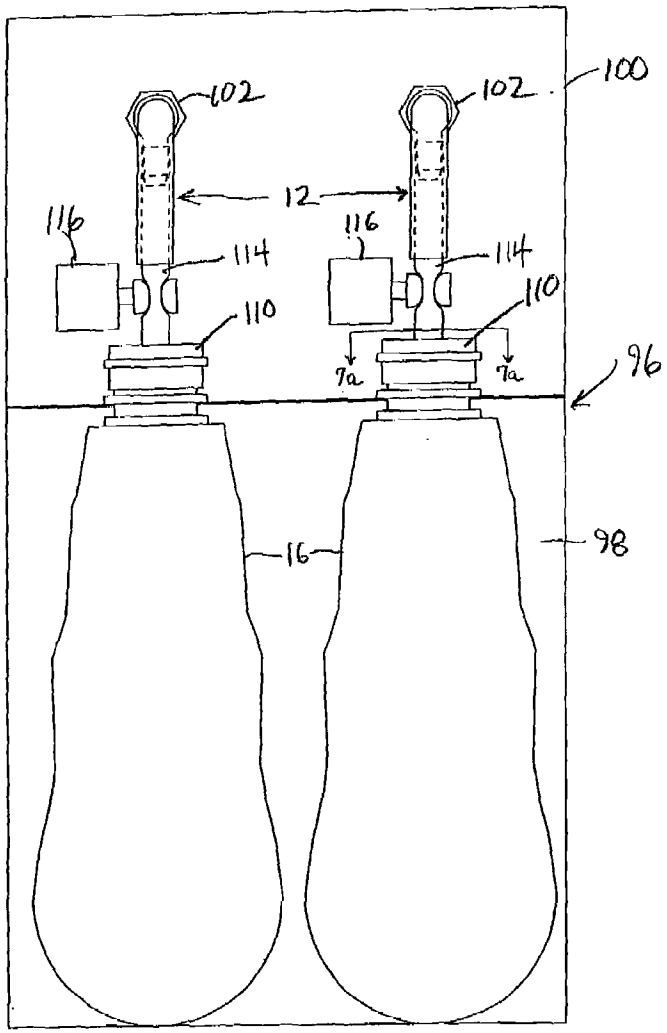
FIG. 2 is a partial, front view of a non-mechanical pump type, post mix beverage dispensing machine showing the dispensing assembly of FIG. 1.

FIGS. 1 and 1*a* illustrate a mechanical pump type, post mix food and beverage dispenser 10 provided with a pair of sanitary, disposable dispensing assemblies 12 embodying the present invention. The beverage dispenser 10 is an upright, box-like construction having an upper, open chamber 14 for receiving and holding a pair of concentrate vessels 16, and a lower, closed housing 18 for routing a diluent, typically water. Each vessel 16 is preferably filled under sterile conditions with a contaminant free, pure concentrate such as a dairy, tea or coffee product which does not require refrigeration, heating or preservatives. As illustrated, it is common to use multiple concentrate vessels 16 so as to dispense more than one type or flavor of liquid food and beverage. Each concentrate vessel 16 is a collapsible, plastic, aseptically sealed container or bag having an inlet fitment 20 and an outlet fitment 22. Extending from the bottom of each vessel 16 is a flexible delivery conduit 24 cooperatively engaged with a respective concentrate pump 26 fixed on the front of the housing 18 and tightly connected to its respective dispensing assembly 12. It should be clearly appreciated that the filled concentrate vessel 16, the conduit 24 and the dispensing assembly 12 are supplied sealed together, and are intended to be disposed of as a unit once the vessel 16 is emptied on the dispenser 10. Each concentrate pump 26 is preferably a peristaltic pump as disclosed in U.S. Pat. No. 5,353,963 issued Oct. 11, 1994 to Gorski et al. As is well known, each pump 26 serves to non-invasively and externally squeeze its conduit 24 so that concentrate from each vessel 16 is pulsatingly forced through the conduit 24 to its dispensing assembly 12.

Figure 3:
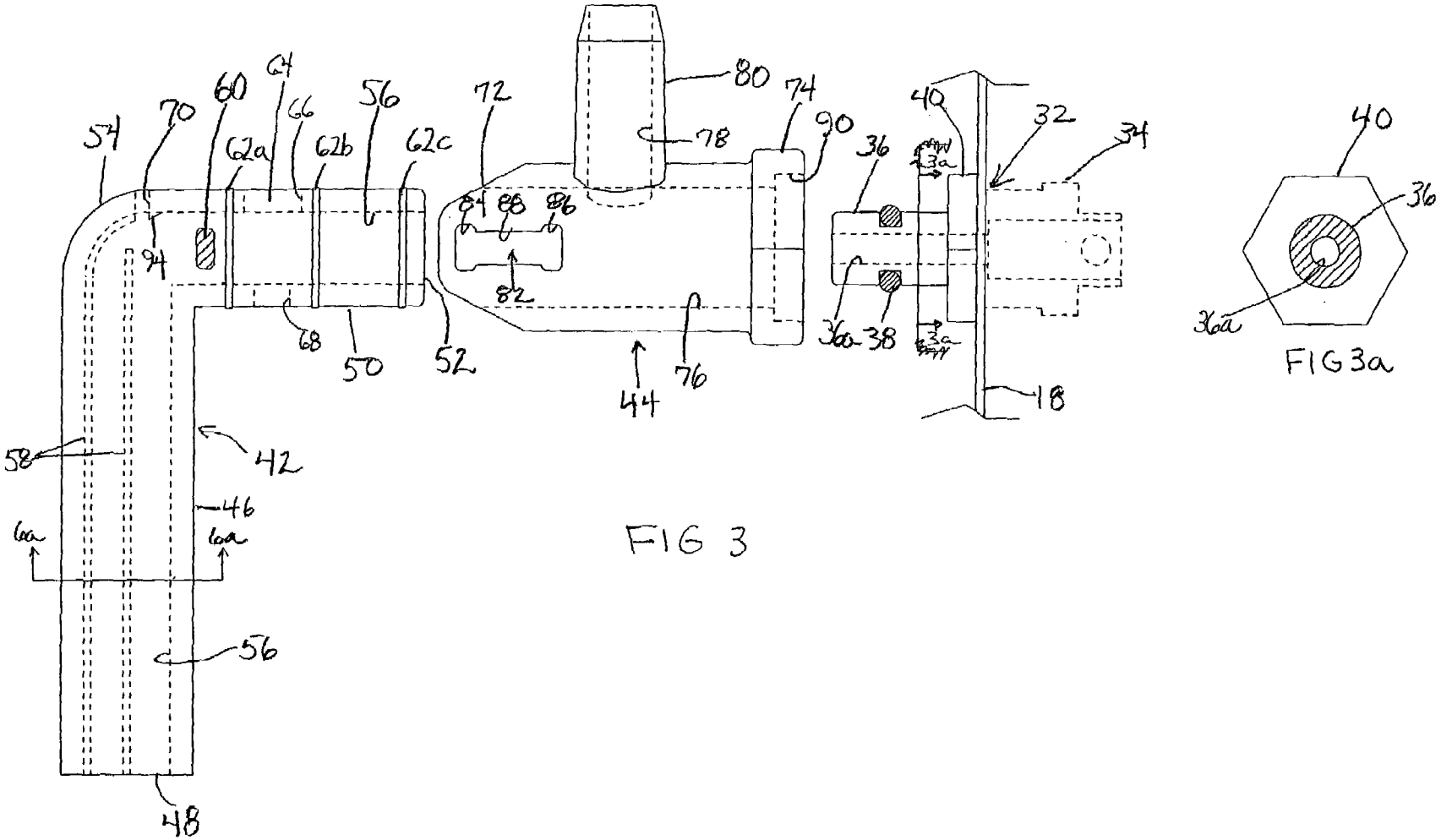
FIG. 3 is an exploded view of a dispense spout and a body forming the dispensing assembly shown in FIGS. 1 and 2.
Figure 7:
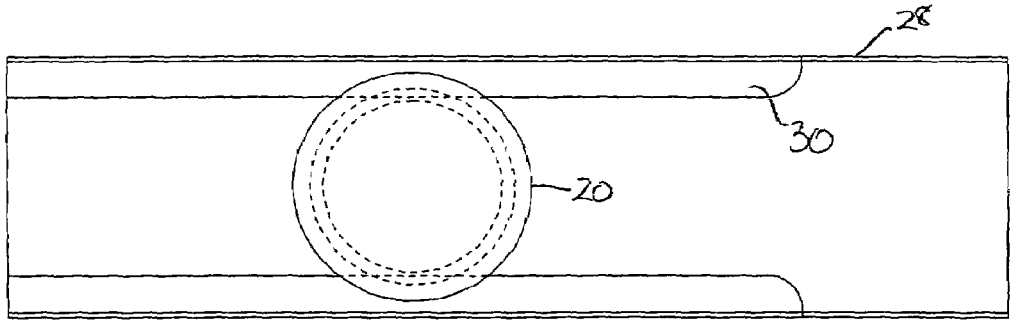
FIG. 7 is a top view of the suspending structure for the inlet fitment of the concentrate vessel taken on line 7—7 of FIG. 1.

A support structure 28 depends from the top of the dispenser 10 and includes a slotted bracket 30 (FIG. 7) from which the inlet fitment 20 of each concentrate vessel 16 is conveniently suspended such that the vessel outlet fitment 22 and the bottom of the vessel 16 rest upon the top of the housing 18. The inlet fitment 20 is slidably inserted into the slotted bracket 30 from the front of the dispenser 10. The upper chamber 14 of the dispenser 10 may also include, if desired, further support structure (not shown) for holding and supporting the outlet fitment 22 of each concentrate vessel 16. Although not illustrated, the dispenser 10 includes a pivotable door provided with suitable controls for activating the dispensing cycles when touched by an operator of the dispenser 10. Similarly, it should be understood that the housing 18 has an associated pump arrangement (not shown) and cooling/heating systems for delivering the diluent or water to a respective water nozzle 32. The dispenser 10 further includes a source of electrical power for providing lighting, and driving the necessary components described. Each water nozzle 32 projects from the front of the housing 18 below a respective concentrate pump 26. As seen in FIG. 3, each water nozzle 32 has an inlet 34 and an outlet 36 equipped with a surrounding O-ring 38 over which each dispensing assembly 12 is sealingly engaged as will be set forth in greater detail below. Outlet 36 has a port 36*a* through which diluent is delivered into the dispensing assembly 12. Each water nozzle 32 includes a hex head periphery 40 (FIG. 3*a*) which serves to externally locate its respective dispensing assembly 12 during installation thereof.

Figure 6:
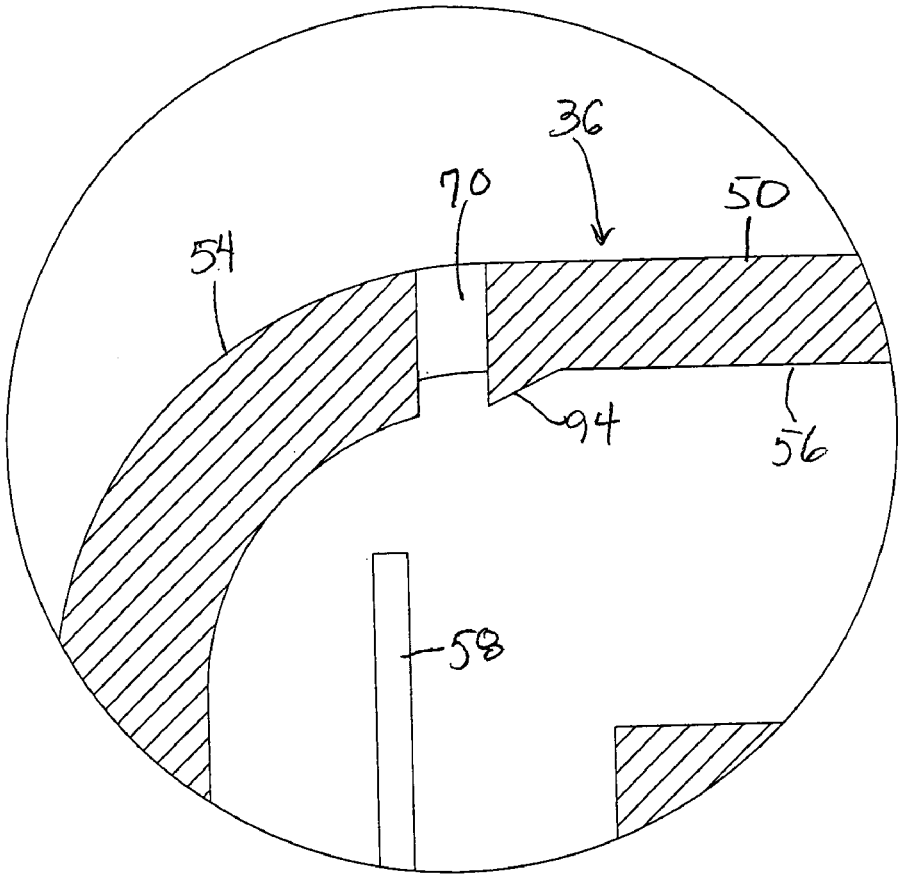
FIG. 6 is an enlarged, sectional detail view of an elbow portion of the dispense spout.
Figure 6A:
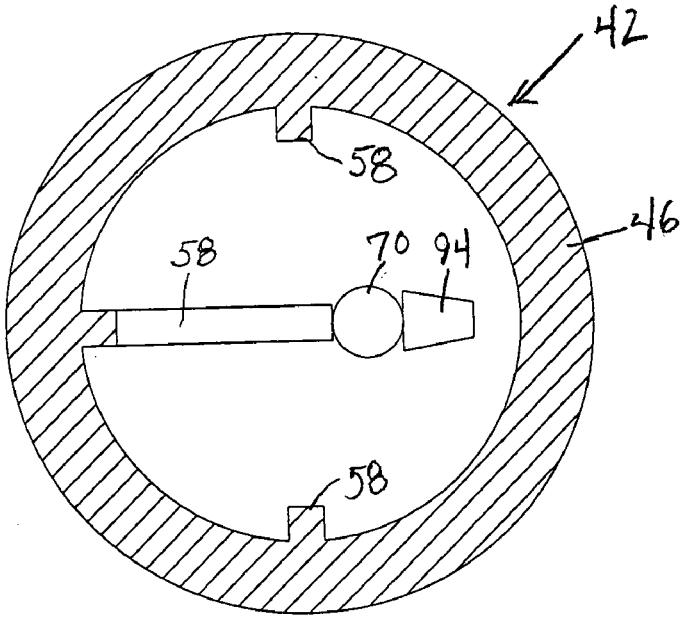
FIG. 6*a* is a sectional view of the dispense spout taken on line 6*a*—6*a* of FIG. 3.

In accordance with the invention, each dispensing assembly 12 is preferably comprised of a molded plastic or nylon dispense spout 42 and a molded plastic or nylon body 44 which are coupled together. Referring to FIG. 3, the dispense spout 42 has a downwardly depending, vertical portion 46 with an open bottom end 48, and a horizontal portion 50 with an open end 52. An elbow portion 54 integrally joins the vertical and horizontal portions 46, 50, respectively. The dispense spout 42 has an internal surface 56 defining a continuous internal throughbore for delivering a reconstituted mixture of pure concentrate and diluent into a container positioned therebelow. The throughbore 56 has a diameter which increases in transition from the horizontal portion 50 to the vertical portion 46. The internal surface 56 is also provided with a series of three spaced apart ribs 58 (FIG. 6*a*) which extend axially along the entire length of the throughbore in the vertical portion 46. The ribs 58 are designed to promote a thorough mixing and agitation of the concentrate and diluent as the mixture moves through the dispensing spout 42. The ribs 58 further serve to maintain a solid stream of the commingled concentrate and diluent so that the mixture dispense will not fan out or disperse at the bottom end 48 of the spout 42.

The external surface of the horizontal portion 50 is formed with an outwardly protruding, resilient, deformable lock tab 60 located on opposite sides of the horizontal portion 50. The outer periphery of the horizontal portion 50 also carries three spaced apart, circumferentially extending sealing beads 62*a*, 62*b*, 62*c* which are adapted to be sealingly received inside the body 44. A passageway 64 is formed vertically through the horizontal portion 50 and is located between the sealing beads 62*a*, 62*b*. As will be explained hereafter, the vertical passageway 64, as seen in FIGS. 3, 4, 4*a*, 5 and 5*a*, intersects the throughbore 56 and has an upper diameter 66 which is larger than a lower diameter 68 to enable the dispensing assembly 12 to be used in a non-mechanical pump type dispenser 96 wherein concentrate is suctioned out of its vessel 16.

The elbow portion 54 of the dispense spout 42 is designed with a vent opening 70 communicating the throughbore 56 with the outside of the spout 42. As will be made apparent, the vent opening 70 provides that the entire reconstituted mixture of concentrate and diluent is drained from the dispensing assembly 12 upon each dispense so as to prevent any bacterial growth therein.

The body 44 is formed with a tapered end 72 and an oppositely disposed enlarged end 74 through which a horizontally extending internal bore 76 passes. The internal bore 76 is sized and shaped to slidingly receive the horizontal portion 50 of the dispense spout 42 at the tapered end 72 of the body 44. The internal bore is formed by an internal surface 76 and communicates with a vertical throughway 78 formed internally through a concentrate inlet 80 integrally joined to the body 44 at a substantially 90 degree angle. The outlet periphery of the concentrate inlet 80 sealingly receives the flexible conduit 24 depending from the concentrate vessel 16. Adjacent the tapered end 72, the internal surface 76 of the bore is formed on opposite sides of the body 44 with a horizontally disposed key hole slot 82 which receives a respective resilient, deformable lock tab 60 on the exterior surface of the dispense spout 42. More precisely, each slot 82 has opposed enlarged segments 84, 86 connected by a narrow channel 88. The enlarged segments 84, 86 are sized similarly to the lock tab 60 so that the lock tab 60 will fit freely therein. However, the lock tab 60 temporarily deforms in the narrow channel 88 when the horizontal portion 50 of the dispense spout 42 is slidably inserted into the body 44 as the dispensing assembly 12 moves from a closed position to an open position as shown respectively in FIGS. 4 and 4*a*. The locking tab 60 and the key hole slot 82 together define a guiding arrangement to enable sliding linear movement of the dispense spout 42 relative to the body 44.

Figure 4:
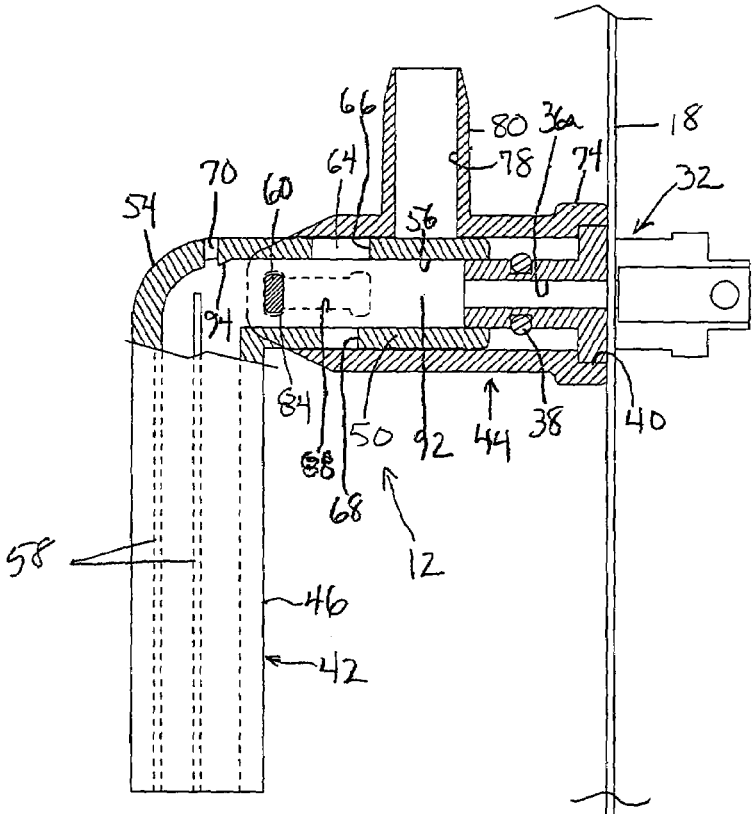
FIG. 4 is an assembled and installed view of a dispensing assembly of FIG. 1 shown in a closed position.
Figure 4A:
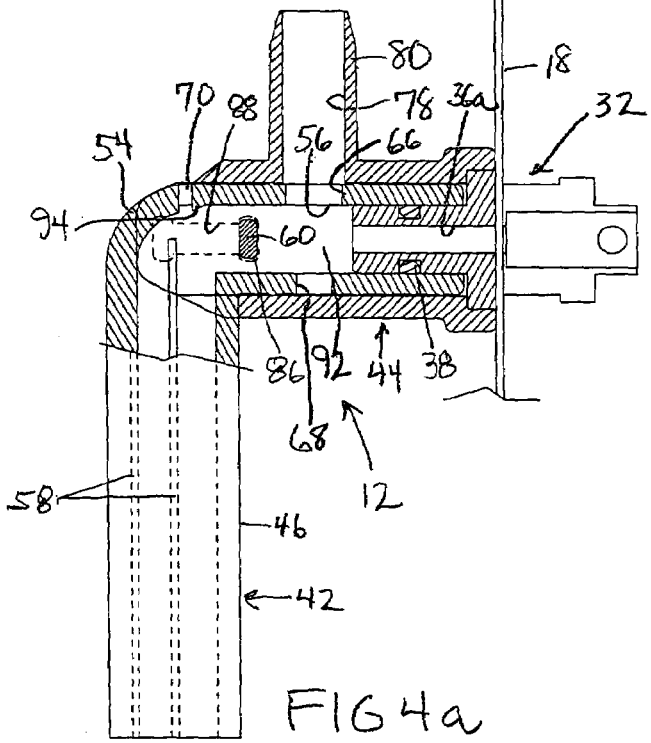
FIG. 4*a* is a view like FIG. 4 but showing the dispensing assembly in an open position.

The enlarged end 74 of the body 44 acts as a water inlet and receives the outlet 36 of the water nozzle 32 in a manner such that the O-ring 38 will sealingly engage the throughbore 56 of the horizontal portion 50 of the dispense spout 42 and retain same when the latter is moved into its open position shown in FIG. 4*a*. The enlarged end 74 is hexagonally recessed at 90 so that it will non-rotatably mate with the hex head periphery 40 of the water nozzle 32.

When assembling the dispensing assembly 12, the horizontal portion 50 of the dispense spout 42 is slidably inserted into the open tapered end 72 of the body 44. That is, the sealing beads 62*a*, 62*b*, 62*c* (FIG. 3) on the dispense spout 42 frictionally and sealingly engage the interior surface of the bore in the body 44 until each lock button 60 snaps into the outermost enlarged segment 84 of its respective key hole slot 82 in the body 44. The length of the dispense spout 42 is chosen so that upon sliding insertion into the body 44, a short length of the spout throughbore 56 at the open end of horizontal portion 50 slides upon the end of the water nozzle outlet 36 to internally locate the dispensing assembly 12 relative to the nozzle outlet 36. This defines the closed position shown in FIG. 4 wherein it should be understood that the vertical passageway 64 between sealing beads 62*a*, 62*b* is purposely out of alignment with the vertical throughway 78 in the concentrate inlet 80. Likewise, it should be recognized that the O-ring 38 on the water nozzle outlet 36 is not yet engaged with the throughbore 56 in the horizontal portion 50 of the dispense spout 42. Once in the closed position, the dispensing assembly 12 is joined to its conduit 24 and its concentrate vessel 16 before being installed on dispenser 10 by the dispenser operator.

In use, each concentrate vessel 16 is suspended from its fitment 20 in the upper chamber 14 of the dispenser 10 and each conduit 24 is engaged with its respective concentrate pump 26. Concentrate cannot freely flow into the dispense spout 42 because the concentrate pump is not yet energized and the vertical throughway 78 of the concentrate inlet 80 is blocked by the outer periphery of the horizontal portion 50 of the dispense spout 42 and the leading sealing beads 62*b*, 62*c*. At this point, the dispenser operator, holding the body 44 externally locates the dispensing assembly 12 by pushing the wall defining the hex shaped recess 90 on the enlarged end 74 of the body 44 onto mating hex head periphery 40 of the water nozzle 32 so that the concentrate inlet 80 is oriented directly upwardly and the dispense spout 42 is positioned directly downwardly.

When it is desired to commence a dispensing operation, the dispense spout 42 is pushed inwardly in a linear motion from its closed position in FIG. 4 to the open position of FIG. 4*a*. In such transition, each lock tab 60 is moved out of its outwardmost engaged segment 84 in its respective key hole slot 82 and because of its deformable construction, forced through the narrow channel 88 until the lock tab 60 resumes its original shape and snaps into the inwardmost enlarged segment 86 of the key hole slot 82. Similarly, the sliding movement causes alignment of the vertical throughway 78 of the concentrate inlet 80 with the throughbore 56 of the dispense spout 42. This occurs as a result of coordinating a certain portion of the length of the key hole slot 82 with the spacing between sealing beads 62*a*, 62*b*, 62*c*. Concurrently, the vent opening 70 in the dispense spout 42 remains open to atmosphere, and the internal surface 56 defining the throughbore in the spout horizontal portion 50 is sealingly received over substantially the remainder of water nozzle outlet 36 and its O-ring 38.

Once each dispensing assembly 12 is installed on its water nozzle 32 and placed in the open position of FIG. 4*a*, dispensing may begin. With a cup placed below each dispensing spout 42, the operator activates a switch and associated controls which energize each concentrate pump 26 and diluent pump so that the pure concentrate and water are simultaneously delivered to a mixing chamber 92 in each dispensing assembly 12. It should be understood that water supplied to the dispenser 10 may have some degree of bacteria which is normally filtered in the housing 18 so that it is pristine before being mixed with the pure concentrate. Once filtered, the water is not exposed to any airborne bacteria. The force of the water stream entering each dispensing assembly 12 will enable an initial mixing of the pure concentrate and water as the combined mixture is driven towards the elbow portion 54. It is to be noted that the driven mixture will not leak out through the vent opening 70 due to a ramped deflector 94 (FIG. 6) formed on the throughbore 56 adjacent the vent opening 70. The ramped deflector 94 diverts the mixture into the vertical portion 46 of the dispense spout 42. Following initial mixing, interaction of the mixture with the ribs 58 in the vertical portion 46 of the dispensing spout 42 will not only provide further thorough mixing and agitation, but will maintain the flow diameter of the mixture in a solid stream as it descends through the vertical portion 46 so that it will not be dispersed or fanned out at the bottom end 48 of the dispense spout 42.

As a major feature of the invention, the vent to atmosphere created by vent opening 70 will effect the throughbore 56 such that all reconstituted pure concentrate and water is evacuated with each dispense. In this manner, no residual concentrate is left to harbor any bacterial growth in the dispensing assembly 12 so as to preserve its sanitary condition. If desired, the dispenser 10 may be designed with timing controls for providing an "after rinse" which provides a short burst of water only through the dispensing assembly 12 after each dispense to add a further degree of sanitation.

Figure 7A:
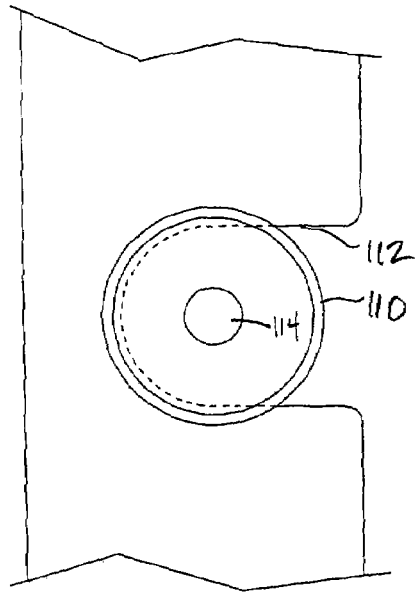
FIG. 7*a* is a view of the suspending structure for the outlet fitment of the concentrate vessel taken on line 7*a*—7*a* of FIG. 2.

Referring now to FIGS. 2, 2*a*, 5, and 5*a*, the dispensing assembly 12 of the present invention is also useful in a food and beverage dispenser 96 not equipped with any concentrate pumps 26. In this version, the dispenser 96 has a lower chamber 98 for holding a pair of concentrate vessels 16, and an upper housing 100 for sheltering miscellaneous equipment and supplying water to the dispensing assemblies 12 attached to the water nozzles 102 at the front of the housing 100. Each concentrate vessel inlet fitment 104 is suspended from a vertically oriented bracket 106 on support structure 108 in lower chamber 98. Each bracket 106 is similar to bracket 30. Each concentrate vessel outlet fitment 110 is slidably inserted and suspended in a horizontally disposed, U-shaped bracket 112 (FIG. 7*a*) formed at the bottom of housing 100. A flexible delivery conduit 114 connects each outlet fitment 110 with a respective concentrate inlet 80. A normally closed, pinch valve 116 is engaged with each flexible conduit 114 and is operated in conjunction with the diluent pump in the housing 100 for a purpose to be set forth below.

Figure 5:
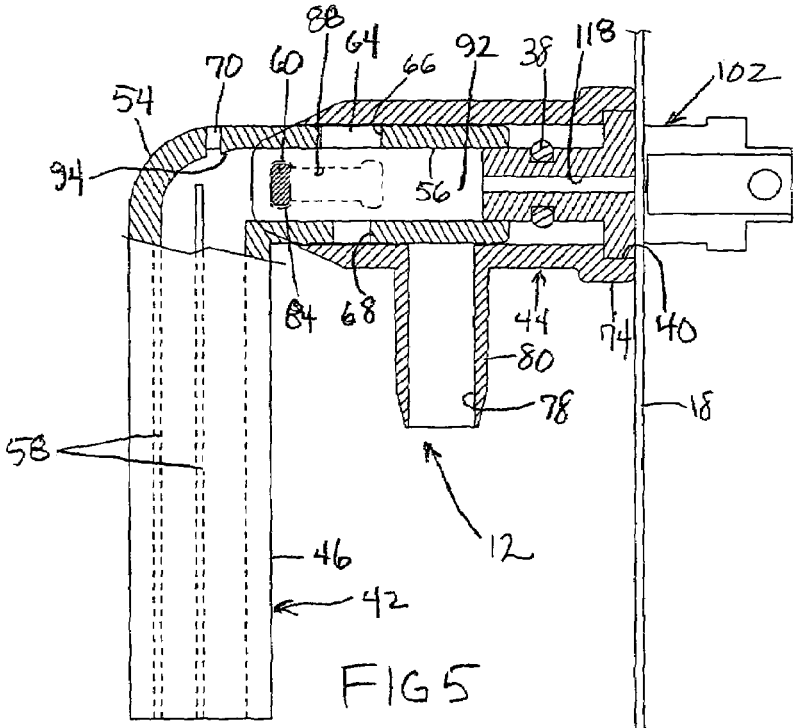
FIG. 5 is an assembled and installed view of the dispensing assembly of FIG. 2 shown in a closed position.
Figure 5A:
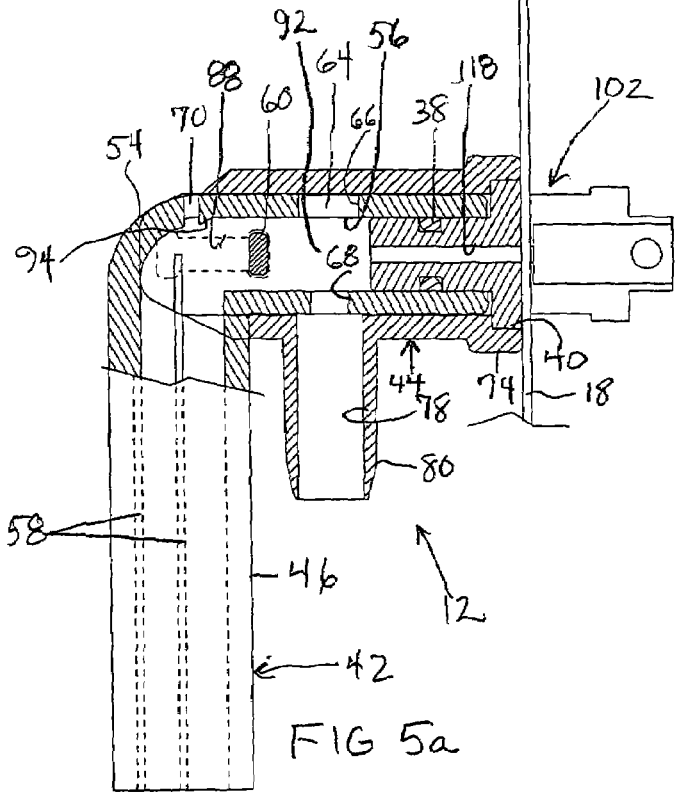
FIG. 5*a* is a view like FIG. 5 but showing the dispensing assembly in an open position.

In the non-mechanical pump type application, it is important to understand that when the dispensing assembly 12 is put together, the dispensing spout 42 is inserted into the body 44 with the concentrate inlet 80 directed vertically downwardly as best seen in FIGS. 5 and 5*a*. With this orientation, the smaller diameter hole 68 at the inner end of the vertical passageway 64 in the dispense spout 42 places the vertical throughway 78 of the concentrate inlet 80 in communication with the mixing chamber 92 and the throughbore 56 in the dispense spout 42 when the dispensing assembly 12 is in the open position of FIG. 5*a*. It is also important to appreciate that the water nozzle 102 has a more restricted inlet 118 as shown in FIGS. 5 and 5*a*, in contrast with water nozzle 32. With this combination, a stream of water passing over the small diameter end 68 of the vertical passageway 64 creates a vacuum or venturi effect to effectively pull or suction concentrate from each vessel 16 into the mixing chamber 92. Each time the diluent pump is actuated to send the stream of water, the pinch valve 116 is opened to allow the pure concentrate to be delivered into the dispensing assembly 12. As the diluent pump cycles off after each dispense, the pinch valve 116 again closes shut upon the conduit 114 to prevent concentrate flow and maintain the prime applied to the concentrate as the latter is progressively exhausted from its vessel 16. The combined pure concentrate and water continue to flow through the dispensing assembly 12 in the manner previously described above in the pump type application.

Once the concentrate has been completed emptied, collapsed bag 16, the conduit 24 or 114 and the attached dispensing assembly 12 are separated from their dispenser 10 or 96 and discarded, and replaced by a newly filled and sealed vessel 16 with an attached conduit 24 or 114 and a new dispensing assembly 12.

The present invention thus provides a dispensing assembly 12 for combining pure or preservative free concentrates with a diluent wherein the concentrate package in a flexible, disposable vessel 16 is conveniently supported inside the dispenser 10 by means of the vessel inlet or outlet fitment 20 or 22. The support of the concentrate vessel or bag 16 prevents collapse of the vessel 16 so that it will not impede flow and eliminates the prior art box used to support the bag so that a cost savings in packaging is realized. The dispensing assembly 12 further provides a sanitary, disposable unit which functions as a shut-off valve on the bag conduit 24 or 114, as well as a mixing valve and dispense spout when installed on the dispenser 10 or 96. The provision of a vent opening 70 enables the dispensing assembly 12 to be completely drained with each dispense so as to prevent bacteria from growing inside the assembly. Moreover, the dispensing assembly 12 can function as a non-mechanical pump to efficiently suction concentrate from a non-gravity fed concentrate vessel 16. The dispensing assembly 12 is designed with internal ribs 58 which ensure the quality of dispensing of a reconstituted food or beverage of a uniform and proper consistency that is constantly delivered as a solid stream without dispersion. The dispensing assembly 12 is particularly useful in sanitary applications of a food and beverage dispenser 10 or 96 when it is highly desirable to provide a substantially contaminant-free beverage without requiring specialized temperature treatment of the concentrate, sanitizing systems or procedures, or "split flow" delivery of the reconstituted mixture.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

We claim:

1. A sanitary, disposable dispensing assembly for providing reconstituted food and beverage by combining a diluent with a food and beverage concentrate, the dispensing assembly comprising:

a dispense spout having an internal surface defining a continuous internal throughbore running through a horizontal portion, and a vertical portion joined by an elbow portion, the vertical portion having an outlet for the reconstituted food and beverage and a plurality of ribs running axially along the internal surface thereof, the elbow portion having a vent opening communicating the throughbore with outside atmosphere and the horizontal portion having a vertical passageway formed with an upper opening and a lower opening, the vertical passageway intersecting the throughbore; and a body having an internal surface defining an internal bore formed therethrough, a diluent inlet for providing diluent flow along a horizontal path of the internal bore, a concentrate inlet having a vertical throughway in communication with the internal bore, the body having an open end opposite the diluent inlet for slidably receiving in a linear motion the horizontal portion of the dispense spout between a closed position wherein the vertical throughway is out of alignment with the vertical passageway and the throughbore of the dispense spout, and an open position wherein the vertical throughway is aligned with the vertical passageway and the throughbore, the vertical passageway and the throughbore defining a mixing chamber for the diluent and the concentrate.

2. The dispensing assembly of claim 1, including a guiding arrangement in the dispense spout and the body for slidably moving the dispense spout along a predetermined linear path relative to the body.

3. The dispensing assembly of claim 2, wherein the guiding arrangement includes resilient, deformable lock tab structure protruding outwardly from an external surface of the dispense spout, and horizontally extending key slot structure provided internally on the body, the key slot structure having enlarged end segments connected by a narrow channel, the key slot structure slidably receiving the lock tab structure.

4. The dispensing assembly of claim 1, including a plurality of sealing beads extending circumferentially around the external surface of the dispense spout in the horizontal portion thereof, the sealing beads being sealingly engaged with the internal surface of the body.

5. The dispensing assembly of claim 1, wherein the diluent inlet is formed with a hexagonally-shaped recess adapted to mate with a hexagonal head of a diluent nozzle mounted on a food and beverage dispenser.

6. The dispensing assembly of claim 1, wherein the upper opening of the vertical passageway in the dispense spout has a diameter which is larger than the diameter of the lower opening.

7. The dispensing assembly of claim 1, wherein the throughbore of the dispense spout increases in size from the horizontal portion to the vertical portion.

8. The dispensing assembly of claim 1, wherein the concentrate inlet is positioned either upwardly or downwardly when the body is cooperatively engaged with the dispense spout.

9. The dispensing assembly of claim 1, wherein the concentrate inlet on the dispense spout is adapted to be connected to a concentrate vessel positioned above the dispense spout and having a delivery conduit engaged with a concentrate pump mounted on a food and beverage dispenser.

10. The dispensing assembly of claim 1, wherein the concentrate inlet is adapted to be connected to a concentrate vessel located beneath the dispense spout and having a delivery conduit independent of a concentrate pump on a food and beverage dispenser.

11. The dispensing assembly of claim 1, wherein the internal surface of the dispense spout is formed with a flow-diverting deflector adjacent the vent opening.

* * * * *